United States Patent [19]

Fayolle

[11] 4,127,264

[45] Nov. 28, 1978

[54] APPARATUS FOR DEPOSITING OBJECTS OF SMALL THICKNESS, ESPECIALLY SKINS, E.G. FOR THE STACKING THEREOF

[75] Inventor: Aime G. Fayolle, Grenoble, France

[73] Assignee: Metraplan SPAA, Claix, France

[21] Appl. No.: 759,370

[22] Filed: Jan. 14, 1977

[30] Foreign Application Priority Data

Jan. 15, 1976 [FR] France ..... 76 01496

[51] Int. Cl.[2] ..... B65H 29/36

[52] U.S. Cl. ..... 271/191; 271/201; 214/6 DK

[58] Field of Search ..... 271/191, 190, 189, 73, 271/67, 218, 201; 214/6 DK

[56] References Cited

U.S. PATENT DOCUMENTS

| | | | |
|---|---|---|---|
| 1,111,667 | 9/1914 | Miehle | 271/191 |
| 3,030,107 | 4/1962 | Stidwill | 271/201 X |

*Primary Examiner*—Bruce H. Stoner, Jr.
*Attorney, Agent, or Firm*—Karl F. Ross

[57] ABSTRACT

An apparatus for stacking skins uses an endless conveyor belt mounted on a support and driven by a drum at an upstream end, and passing around a pair of rollers. The latter are displaceable relative to the drum to define a pair of retractable and extendable conveyor arms at the downstream end by a pair of chains for cyclically displacing the rollers to extend an upper one of the arms while retracting a lower one of the arms simultaneously. A bar is affixed to the conveyor belt and is engageable with notches on the support upon the displacement of said conveyor belt for retaining a portion of the conveyor belt between the rollers.

21 Claims, 10 Drawing Figures

APPARATUS FOR DEPOSITING OBJECTS OF SMALL THICKNESS, ESPECIALLY SKINS, E.G. FOR THE STACKING THEREOF

FIELD OF THE INVENTION

The present invention relates to an apparatus for the stacking of objects of small thicknesses, especially skins and, more particularly, to an improved apparatus for the handling of highly sensitive, readily foldable and creasable flat objects which must be deposited in a flat condition.

BACKGROUND OF THE INVENTION

In the handling of thin objects and especially flat objects with regular or irregular outlines for a variety of purposes, especially skins in tanneries or the like, means have been provided for laying the flat object upon a receiving surface and/or stacking the objects upon such surfaces.

In the mechanization of tannery processes and especially the handling of skins therein, considerable difficulties have been encountered because of the nature of the object and the manner in which it must be deposited or stacked.

Apparatus has been proposed heretofore for manipulating, e.g. automatically stacking, skins without considerable success. It should be noted, however, that improvements in apparatus for the stacking of skins, with which the present application is particularly concerned, are not limited in applicability to these objects but can be used for the handling of other thin, flat objects such as certain wood products in the wood industry.

In the tanning industry the skins are displaced successively on or in the treatment machines (surface treatment, pistoletting, drying, measuring etc.) by endless conveyor belts. These conveyor belts can be constituted by parallel wires which are independent from one another but are sufficiently close together to provide the necessary support while permitting the passage of air and light.

In order to deposit the skins, it is necessary to raise the wire conveyor, if possible before it reaches the return roller, to avoid wedging the skin between the wires and this roller and thereby damaging the skin or the apparatus. The skins must be deposited by the apparatus upon a table, a pallet or a frame or horse. It is also a common requirement that the skins alternately be reversed to deposit the flesh side of one skin against the flesh side of another and the grain side against grain side. This mode of stacking is known as a "marriage" of the skins.

As previously indicated, several devices have been proposed to carry out this type of stacking and skin-depositing, but all have drawbacks. Certain of these devices utilize endless bands while others employ fork-like members to lay down the skins. The principal disadvantages of these devices are the following:

(a) The displacement of the skins on their conveyors is unreliable;

(b) the speed of the skin at the moment at which it is deposited, relative to the receiving surface, is not zero so that the stacking is unreliable; and (c) the apparatus generally comprises carriages and other elements actuated with rapid and sharp reversing movements which give rise to shocks in the mechanism and a high degree of wear and tear.

The apparatus designed for the depositing and stacking of flat objects, e.g. sheets of paper, is known and has some of the capabilities required for an apparatus intended to stack or deposit skins in tanneries or the like. These systems use an endless belt conveyor having a run or stretch, one end of which is fixed with respect to the receiving surface while the other end is retractable under the object to be deposited. This principle is highly effective because it theoretically permits the deposition of the object at zero velocity. However, the apparatus is highly complex and, when applied to the stacking of skins, tends to fold them or pinch them accidentally between the belts or cables forming the endless conveyor surface and the return drum or rollers.

OBJECTS OF THE INVENTION

It is the principal object of the present invention to provide a versatile apparatus free from the drawbacks enumerated above and especially effective in the deposition and stacking of such thin generally flat objects as skins adapted to be processed or previously subjected to processing in tanneries or the like.

Another object of the invention is to provide an apparatus for the purposes described which is of improved reliability, of simpler construction and of lower cost than earlier apparatus for similar purposes.

It is also an object of the invention to improve the functioning of a skin-stacking apparatus and to reduce the maintenance costs involved in operating such an apparatus.

SUMMARY OF THE INVENTION

These objects and others which will become apparent hereinafter are attained, in accordance with the present invention, in an apparatus which eliminates the disadvantages of the prior systems, both with respect to construction of the apparatus and its functioning, and which utilizes an endless conveyor formed as a single unit without an assembly of belts or cables which allows the deposition of the skin or other object at zero velocity while having a significantly reduced number of moving parts; the apparatus is also of simple construction and light weight, thereby permitting its operation at elevated speeds.

The apparatus according to the invention comprises an endless conveyor of the blanket type, i.e. a single flexible conveyor belt forming the transport surface for the skins and roller means supporting this conveyor so that it has a substantially fixed upstream end adapted to receive the skins and a downstream end capable of retraction to deposit the object at zero velocity.

More specifically, the conveyor belt, according to the invention, passes at its upstream end (i.e. the rear of the apparatus) over a drive drum which can be continuously or intermittently driven and, at its opposite side, over a pair of rollers which are inversely displaceable by respective pairs of lateral chains disposed along opposite sides of a support frame upon which the elements of the apparatus are mounted. Fixed to the conveyor belt at distances spaced substantially by half the effective length thereof are a pair of transverse bars which are alternately engageable in notches carried by the support frame and positioned so that the advance of one of the rollers with the upper pass or stretch of the chains will draw the conveyor belt out to form a tongue having an upper stretch and an intermediate lower stretch. The latter is temporarily fixed at the bar engaged in the notches and the other roller forms an intermediate upper stretch and a return stretch.

Thus, while the upstream end of the conveyor belt has only two stretches in this phase of the operating cycle, the downstream end has four stretches as just described. The skin on the upper stretch at the downstream end can thus be turned over onto a skin carried by the upper stretch of the second arm of the conveyor therebelow and from which a previous skin is deposited on the stack.

This configuration has the advantage that the skins are laid onto the stack in pairs with their respective flesh side to flesh side or their respective hair side to hair side in the aforementioned "marriage" of the skins.

In other words, the downstream side of the conveyor is periodically transformed into two conveyor arms disposed one above the other such that, as the upper arm advances over the lower arm and the lower arm retracts, the upper arm can turn over a skin onto a skin on the lower arm which simultaneously deposits the skins at zero velocity on a receiving surface, e.g. on a stack of skins disposed therebelow. When the cycle is complete, the conveyor reaches its maximum extension and the two arms merge into a single downstream extremity upon which a skin is deposited and the process or cycle repeats.

For clarity of understanding of the subsequent description, it is important to reiterate the fact that the skins arrive at the apparatus at the upstream or rear side thereof and are discharged or stacked by the downstream or front part of the conveyor belt.

An important feature of the invention resides in the means, namely, the aforementioned bars and notches, which establishes a fixed portion of the conveyor belt during the formation of the two conveyor arms and the transfer of a skin from the upper arm onto the lower arm while the latter is depositing a previous skin onto the stack.

The retraction of the roller forming the lower arm during this process ensures deposition of the skins at zero relative velocity (with respect to the stack and the belt surface carrying same) and reliable stacking of the skins in face-to-face and reverse-to-reverse relationship is ensured.

The driving elements of the apparatus always operate in the same sense, i.e. in spite of the advance and retraction of the rollers, there are no reciprocating parts and hence operation at high speed is possible without the danger of vibrations and shocks causing premature damage to the apparatus. The speed at which the stacking apparatus operates can be of the same order of magnitude as the conveyor means whereby the skins are fed to the apparatus and hence of the same order of magnitude as the processing machinery.

Depending upon the speed of the belt and the timing of arrival of the skins, it is possible to stack the latter in a simple manner, i.e. in their original positions without "marriage" or to reverse all of the skins from their original lay, or to bring about the "marriage" of the skins as described previously.

According to a preferred feature of the invention, the two transverse bars carried by the endless belt are fixed to the outer face thereof and extend slightly beyond the edges of the belt, i.e. are of a length slightly greater than the width of the belt. The central part of the support frame can carry two symmetrical members disposed laterally of the belt and having rearwardly open notches of V-profile and adapted to receive the respective extremities of each bar when the latter is to be maintained immovably.

Advantageously the two members forming the notches have extensions toward the rear of the apparatus which form guides converging toward one another in the forward direction and toward the crotches or vertices of the notches. While one of the bars is entrained by the belt it is guided toward the notches by these guides and securing of the bar in the notches is thus ensured automatically. This also ensures automatic centering of the conveyor belt itself.

According to another feature of the invention each of the lateral chains passes over a drive sprocket wheel or pinion disposed in the center of the apparatus and having its axis slightly rearwardly of the aforementioned notch and over a return pinion disposed at the front of the apparatus, the two drive pinions and the two return pinions having common axes. However, the two drive pinions and the two return pinions are mounted on independent shafts spaced apart sufficiently to clear the respective passes or stretches of the endless conveyor belt.

The shafts of the drive pinions are connected to a common motor by transmission means ensuring synchronization of their rotation. This coupling of the angular positions of the two drive pinions is necessary to ensure synchronization of the two lateral chains and hence to maintain parallelism of the two rollers whose extremities are connected to the two chains.

The developed length of the endless conveyor belt is preferably selected to be substantially equal to four times the interaxial distance between the drive and return pinions of the lateral chain plus four times the effective radius of the return pinions, plus the circumference of a return roller about which the arms of the conveyor are formed and which are connected to the chains. The choice of length of the belt permits the arrival of one of the transverse bars into proximity to said notches just before the instant at which the other bar is withdrawn from the notches. Of course, the developed length of the endless belt should be at least four times the maximum length of the objects to be stacked for effective functioning.

Preferably the drive drum of the conveyor is mounted on the frame of the apparatus movably, e.g. swingably, and means is provided to bias the mount for this drum so as to ensure a permanent tension on the belt. The shaft of this drum is advantageously connected to a motor by transmission means of the slip type such that a continuous driving force is applied to the belt, preferably with a surface velocity greater than twice the linear velocity of the lateral chains and such that the upper stretch of the belt is displaced from the rear of the apparatus toward the front thereof.

During the course of the greater portion of the operating cycle, the conveyor belt has a point thereof, i.e. one of the bars, fixed with respect to the support ahead of the rollers about which the conveyor belt passes so that the rollers form a pulley or tackle system which generates at the upper stretches and lower stretches a linear velocity twice that of the lateral chains with which the rollers themselves are displaced. The peripheral velocity of the drive drum of the conveyor belt is only slightly greater to continuously apply to the belt, in addition to the tension previously mentioned, a tractive force which serves primarily to remove one of the transverse bars from the notches just before the arrival of the other bar and to introduce the latter bar into the notches subsequent to its arrival.

Rearwardly of the axis of the drive or first pinions of the lateral chains and substantially at the level of the notches, I provide an idler roller over which the upper stretch of the conveyor belt passes. This roller serves to ensure that the arriving transverse bar will be fed to the notches at a conveyor level while permitting the bar which is concurrently withdrawn from the notches to pass without interference therefrom. Furthermore, another idler roller can be mounted below the axis of the first or drive pinions of the lateral chains to support the lower stretch of the conveyor belt, i.e. in a region proximal to said notches. The lower stretch is thus held up after deposition of the objects.

The frame of the apparatus is provided, according to a feature of the invention, with a conveyor (feed conveyor) for supplying the objects to be deposited and advantageously having detector means responsive to the passage of the objects and adapted, via appropriate circuitry, to start the lateral chains at an instant corresponding to the arrival of each object. While the feed conveyor can be realized in any conventional form, it has been found to be advantageous, in the stacking of skins, to use a disk conveyor. The detector means can ensure a correct synchronization of the conveyor belt with the cadence of arrival of the skins.

Finally, according to an important feature of the invention, the circuit is a frame which is mounted pivotally at its rear end so that its front end can be swung upwardly, about a transverse axis at the rear end in response to a detector for the objects deposited so as to raise as the deposited stack rises.

The detector means of the feed conveyor can comprise a pair of light curtains whose photoelectric devices are connected to circuitry designed to determine the position of the longitudinal center of the objects arriving on the disk conveyor so that the skins or other objects can be centered perfectly on the stack and on the conveyor belt.

The detector for the deposited objects can also include a photoelectric device responsive to a light beam which is interrupted as the stack rises. Circuit means is provided so that temporary interruption of this light beam during the course of the operating cycle, i.e. upon the deposition of an object on the stack does not bring about a premature elevation of the support. This circuit means thus is designed such that the support is swung about its horizontal axis only when its light beam is interrupted permanently in the course of a complete cycle of deposition of an object.

After the motor connected to the lateral chains has been started in the manner indicated above, it is stopped in the end of a cycle by a command generated by a rotatable cam cooperating with fixed electrical contacts or by limit switches.

BRIEF DESCRIPTION OF THE DRAWING

The above and other objects, features and advantages of the present invention will become more readily apparent from the following description, reference being made to the accompanying drawing in which.

SPECIFIC DESCRIPTION (a) General

Figure 1:
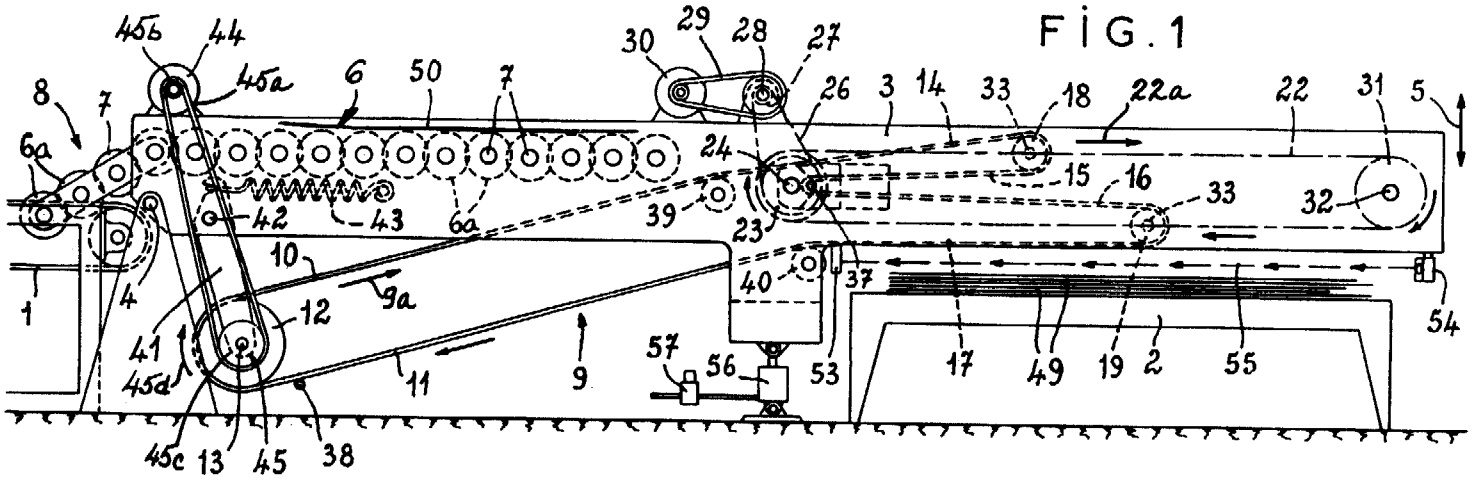
FIG. 1 is a side-elevational view, partly in diagrammatic form, of a stacking apparatus in accordance with the principles of this invention.
Figure 2:
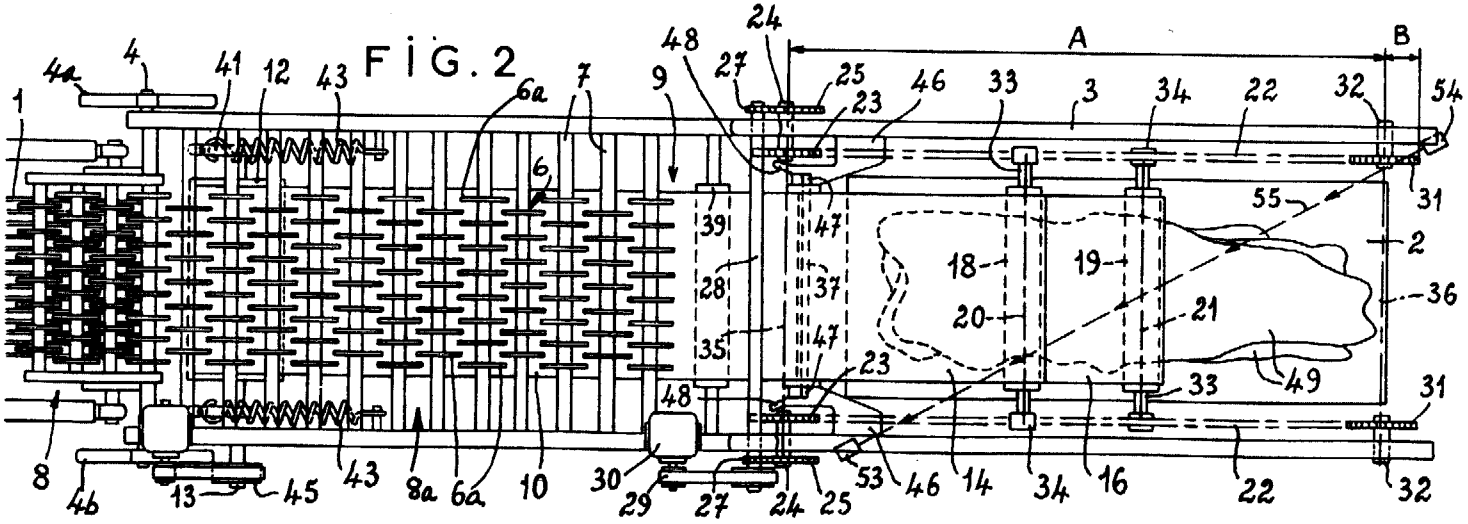
FIG. 2 is a plan view thereof.

The apparatus for the stacking of skins according to the invention is disposed, as can be seen from FIGS. 1 and 2, between an entry conveyor 1, composed of parallel cables and upon which the skins arrive in succession, and a horizontal table 2 upon which the skins are to be piled or stacked.

The frame 3 of the apparatus is mounted for pivotal movement about a horizontal axis 4 at an upstream end of the frame on a pair of trunions **4*a* and 4*b*. The axis 4 lies above the surface of the conveyor 1 at the upstream end and permits swinging movement of the frame 3 to enable its downstream end to be raised or lowered as represented by an arrow 5**.

In order to simplify the explanation of the functioning of the apparatus, it can be assumed for the present that the frame 3 is fixed with respect to the axis 4 and that all of the elements now to be described are positioned with respect to the frame 3 unless otherwise indicated. Of course, use of the term "fixed" in this respect means only that the elements are mounted upon the frame 3; they can, perforce, move with the frame when the latter is swung about the axis 4.

At its end proximal to the entry conveyor 11, the apparatus is provided with feed means for transferring the skins to the apparatus, the necessary motors, speed reducers and ancillary systems. The central portion of the apparatus and its end distal from conveyor 1 and overlying the receiving table 2 are provided with means especially adapted to deposit the skins.

(b) Skin-Feed Conveyor

The feeding means, as can be seen from FIGS. 1 and 2, are constituted in the embodiment under consideration by a disk conveyor 6 whose disks **6*a* are rotatable with respect to shafts 7 and a horizontal axis and are driven by means not shown so that all of the disks 6*a*** rotate with the same peripheral speed.

The shafts 7 are journaled in opposite walls of the frame 3 and are horizontally spaced apart in mutually parallel relationship with a distance less than the diameter of the disks, all of which can be of identical diameter. The disks of successive shafts 7 are staggered so that they interdigitate as can be seen from FIG. 2.

The disk conveyor 6 has an upwardly inclined entry ramp 8 whose lower end is received below the plane of the conveyor 1 and which rises to a level thereabove. The disks in the lower end of the ramp 8 are disposed between the cables of the conveyor 1 as can best be seen from the plan view of FIG. 2. The remainder **8*a*** of the disk conveyor is substantially horizontal.

(c) Conveyor-Belt Assembly

The device for depositing the skins comprises a flexible entry conveyor belt 9 capable of undergoing deformation, preferably comprising a rubber blanket or bar formed as a single piece. The conveyor belt 9 has an upstream end formed with a pair of substantially parallel stretches or runs 10 and 11 located below the disks 6a of the substantially horizontal portion 8a of the disk conveyor 6 and passing around an upstream drum or roller 12 journaled between opposite sides of frame 3 on arms 41 and rotatable about a horizontal axis 13. The drum or roller 12 constitutes the driving drum of the conveyor belt 9. At its downstream end, the conveyor belt 9 has four stretches or runs 14, 15, 16 and 17 which are substantially parallel.

Thus the belt 9 has, at its downstream end, two extremities defined by the rollers 18 and 19 over which the belt returns from stretch 16 or stretch 17.

The rollers 18 and 19 have respective horizontal axes 20 and 21. The deformations of the belt are brought about by means of an entrainment device which permits the simultaneous synchronous displacement of the two axes 20 and 21 and hence the rollers 18 and 19.

(d) Roller-Entraining Assembly

The entrainment device essentially comprises two lateral endless chains 22 disposed along the opposite sides of the frame 3. Each chain 22 passes over an entrainment sprocket wheel or pinion 23. Each pinion 23 is keyed to a respective shaft 24 of a pair of such independent shafts journaled on the opposite sides of the frame 3 so that the space between them remains open to permit the free passage of the various stretches of the belt 9.

Two other sprocket wheels or pinions 25 are also respectively keyed to the shafts 24 and are connected by the respective chains 26 to two further sprocket wheels or pinions 27 keyed to a common shaft and journaled on the frame 3 for free rotation about a horizontal axis above the transport path of the skins. The shaft 28, pinions 27, chains 26 and pinions 25 ensure synchronous operation of the two chains 22. The shaft 28 is itself connected by a drive belt 29 to the input shaft of a speed reducer on a motor 30 mounted on the frame 3.

Each of the lateral chains 22 also passes over a return sprocket or pinion 31 mounted on a respective shaft 32 which is journaled in a respective side of the frame 3 at the downstream end thereof. As with the drive pinions 23, the pinions 31 are independently mounted and spaced apart so as to leave a gap between them for passage of the stretches of the belt 9.

The two ends of each of the rollers 18 and 19 are adapted to rotate freely about respective pairs of fingers 33, of which a total of four are provided, the fingers 33 being connected by links 34 to respective stretches or passes of the chans 22. Thus, in the position illustrated in FIG. 1, the axis of the roller 18 is entrained by the upper passes of chains 22 while the axis of roller 19 is entrained by the lower passes of chains 22. The fingers 33 and the links 34 of each roller 18, 19 are so disposed that the respective axes 20 and 21 always remain parallel to the theoretical axes 35 and 36, respectively of the drive pinions 23 and the return pinions 31 of the chains 22. Furthermore, the distance separating the two fingers 33 attached to the chain 22 is such that the chain is divided by them into two parts of equal length.

(e) Belt Characteristics

The width of the endless belt 9 is constant and is less than the spacing between the two shafts 24 on the one hand and the two shafts 32 on the other hand, as indicated previously. The developed length L of the endless belt 9 is given by the relationship:

$$L = 2(2A+2B+\pi R)$$

where:

L is the developed length;

A is the interaxial spacing of the pinions 23 and 31, i.e. is the distance separating the theoretical axes 35 and 36;

B is the effective radius of the return pinions 31; and

R is the radius of the rollers 18 and 19 which have the same diameter.

Upon the external face of belt 9, there are fixed two transverse bars or rods 37 and 38 which have lengths slightly exceeding the width of the belt so that the ends of these bars 37, 38 project slightly laterally over the edges of the conveyor belt 9. The two bars divide the belt 9 into two parts of equal length approximately:

$$L/2 = (2A+2B+\pi R).$$

The upper run 10 of the conveyor belt 9 passes over an idler roller 39 whose horizontal axis is fixed with respect to the frame 3 and is disposed upstream of the axis 35 of the pinions 23. Similarly, the lower run 11 passes over an idler 40 disposed below and slightly downstream of the axis 35. The axis of idler 40 lies fixed on the frame 3.

(f) Belt Drive

The axis 13 of the drive drum 12, previously mentioned around which the upstream end of the endless conveyor belt 9 passes, is rotatably mounted on the two downwardly extending arms 41 which are rigidly connected together by a shaft 42 rotatable on the opposite walls of the frame 3 and constituting a pivot for these arms. Tension springs 43 engage lugs of the arms 41 remote from the drum 12 and urge these arms 41 in the clockwise sense (FIG. 1) to maintain a constant tension on the belt 9. The arms 41 thus constitute levers for tensioning the belt 9 and are fulcrumed at 42 on the frame 3.

The drum 12 is rotatably driven by an electric motor 44 provided with a speed reducer and mounted on the upstream end of the frame 3. A drive belt 45a passes over the drive pulley 45b of this motor-reducer 44 and over the pulley 45c carried by the shaft 13 of the drum 12 to drive the latter in the clockwise sense indicated by arrow 45d in FIG. 1. Members 45a–45c thus constitute a friction or slip transmission interposed between motor 44 and the drum 12 of the conveyor belt 9. If the belt has not been raised, therefore, it is driven (arrow 9a) in the same sense as the displacement of the chains 22 (arrow 22a) with a circumference speed slightly greater than twice the linear velocity V of the rollers 18 and 19 which are displaced by the lateral chains 22.

(g.) Notch Assembly

Figure 3:
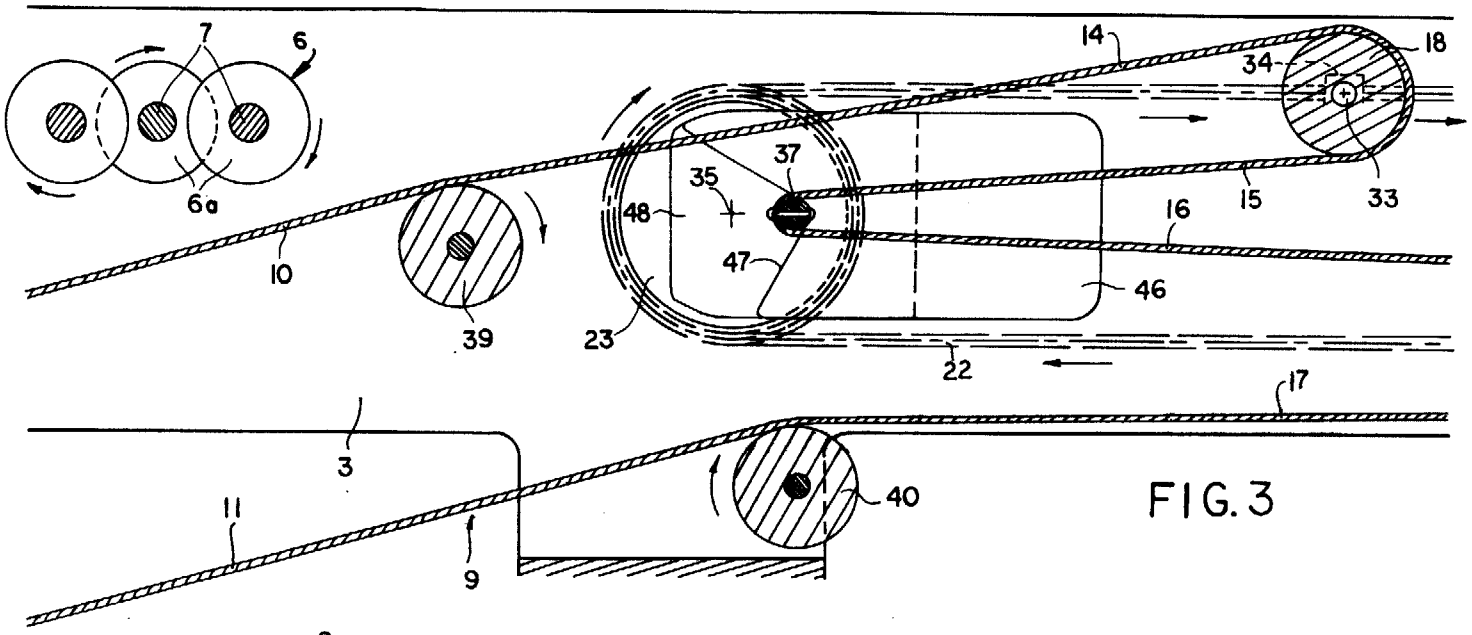
FIG. 3 is a partial longitudinal section, drawn to an enlarged scale, illustrating the central portion of the apparatus of FIGS. 1 and 2.
Figure 4:
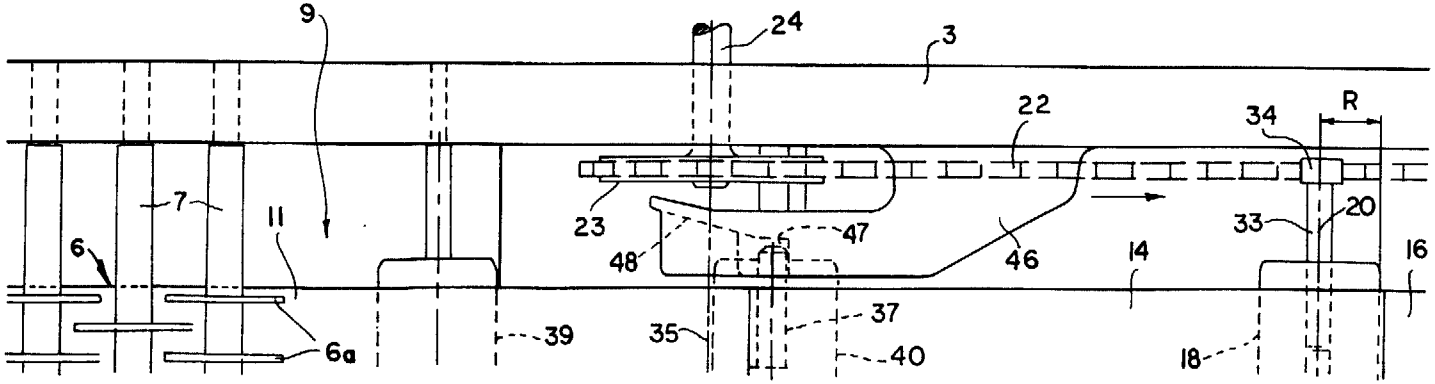
FIG. 4 is a plan view of the portion of the apparatus shown in FIG. 3.

As shown particularly in FIGS. 3 and 4, a pair of lateral symmetrical notched members 46 of rearwardly open V profile 47 are fixed to the central portion of the frame 3 on the opposite walls thereof. The two members 46 are spaced apart by substantially the width of the belt 9 but by a distance which is slightly less than the length of the bars 37 and 38 fixed to this belt.

The notches 47 are disposed substantially at the level of the axis 35 of pinions 23 and of the upper generatrix of the idler roller 39 (FIG. 3). The bottom of this notch is disposed slightly downstream of the axis 35 and is turned toward the rear of the apparatus. Rearwardly of the notch 47, members 46 are formed with extensions 48 which diverge rearwardly (see FIG. 4) and constitute guides converging toward the forward end of the machine and directing the bars 37 and 38 into the crotch of the notch.

Thus, as will be described in greater detail hereinafter, during a specific phase in the cycle of operation, one of the bars 37 and 38 can be engaged in the notches 47 of members 46 while the rollers 18 and 19 lie forwardly thereof to define the four stretches 14–17 of the conveyor belt 9 described previously. The conveyor belt 9 can bend around the bar engaged in the notch to form a point at which the conveyor belt is temporarily anchored so that intermediate passes 15 and 16 of the belt adjoin at the engaged pair (e.g. 37 as can be seen in FIG. 3).

(h.) Operation

FIGS. 5 through 9 illustrated schematically the successive positions of the conveyor belt 9 in its principal operating phases, these phases in succession constituting a "cycle" in accordance with the invention.

Figure 5:
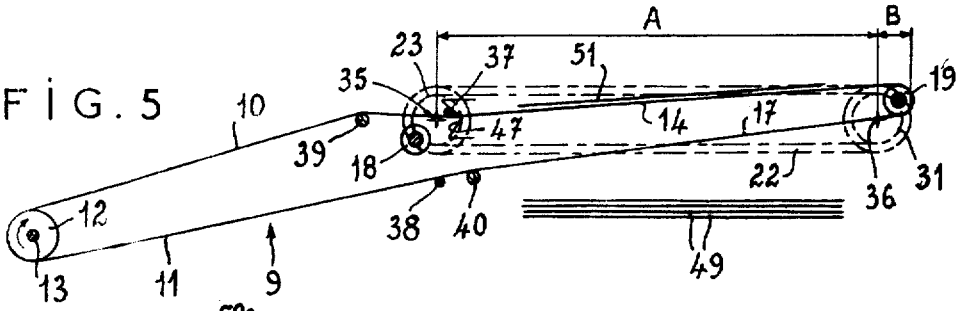
FIGS. 5 through 9 are diagrammatic side-elevational views, partially in section, showing successive positions of the skin-depositing apparatus of the invention.

In the position chosen as the starting position for a cycle, illustrated in FIG. 5, the apparatus is about to receive an object to be stacked. The lateral chains 22 are halted such that the rollers 18 and 19 lie diagonally opposite one another, the roller 18 being immobilized in the region of the drive pinions 23 and slightly rearwardly and below their axis 35. The roller 19, at the same time, is stopped in the region of the return pinion 31 and slightly forwardly and above their common axis 36. In this position, the belt 9 does not form two tongues at the righthand extremity but has only two stretches, namely, the upper stretch or run 10, 14 carrying the bar 37 which is held in the crotch of the notches 42 because of the traction exerted upon the belt 9, and a return stretch or run 11, 17 carrying the bar 38 which is free to move and passing around the roller 19, over the idler 40 and around the drive drum 13. The roller 19 here lies to the right of the end of the stack of objects 49 previously deposited. In this position, moreover, the second bar 38 lies substantially below the first bar 37 which is engaged in the notches 47 according to the selected length of the belt 9 as a function of the dimensions A, B and R mentioned previously.

Figure 6:
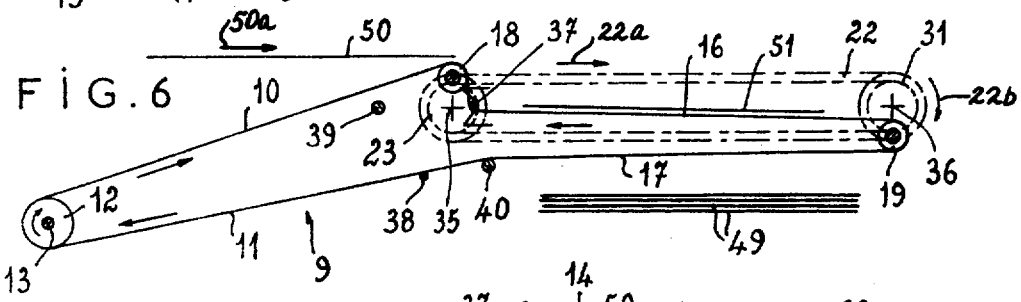

In the next phase of the cycle, represented in FIG. 6, a new object 50 to be deposited, e.g. a skin, is advanced by the disk conveyer 6 in the direction of arrow 50*a* and meets the conveyor belt 9 just above the roller 18 which has been swung about 120° around the axis 35 by an advance of the chains 22 in the direction of arrow 22*a*.

To effect this displacement of the chains 22, the motor-reducer 30 is energized and drives the shaft 28 via the belt 29 to rotate the pinions 27 and enable the chains 26 to drive the pinions 25 and the shafts 24 connected to the pinions 23 about which the chains 22 extend. The roller 19 is thereby swung in the clockwise sense (arrow 22*b*) through about 120° until it lies along the lower stretches of the chains 22, roller 18 being disposed substantially at the upper stretches hereof.

Figure 7:
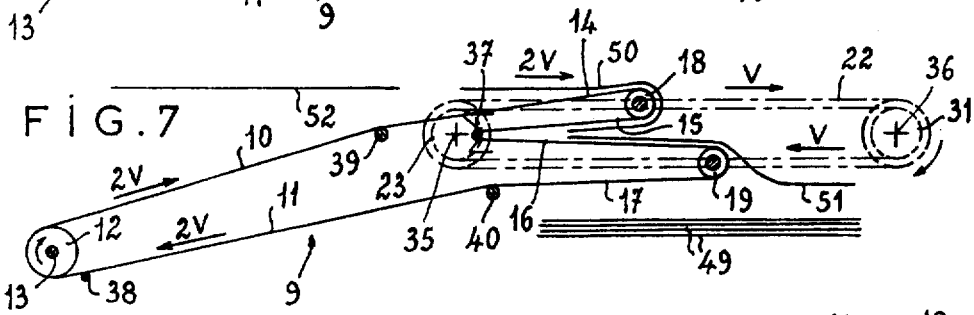

A previous object or skin 51, carried by the upper stretch 14 is meanwhile advanced in the direction of arrow 22*a* while bar 37 remains engaged in the notches 47 as is necessary for the formation of the additional stretches (FIG. 7).

Continued operation of the chains 22 and driving of the belt 9 via the motor-reducer 44 and the drum 12 carries the bar 38 to the left while advancing the objects 50, 51 with the belt 9 to the right. As the roller 18 is carried to the right by the upper passes of the chains 22 (FIG. 7), it draws the upper stretch of the belt 9 away from the bar 37 to form the two stretches 14 and 15. Meanwhile the roller 19 entrained by the lower stretches of the chain 22, advances toward the bar 37 and defines the two passes 16 and 17 described previously in connection with chains 1 and 3.

The chains of the roller 18 to the right (velocity V) brings the passes 14 and 15 of the conveyor 9 above the previously disposed object 51 and causes the object 50 to roll over onto the object 51 while retraction of roller 19 (Velocity V) deposits the object 51 at zero velocity upon the stack of skins 49.

In FIG. 7, the conveyor 9 is represented substantially at midcycle. The surface speed of the pass or stretch 16 is equal to the peripheral speed of the roller 19 as it is retracted to ensure zero velocity deposition of the skin 51 on the stack 49.

If the roller 18 is entrained forwardly with the upper stretch of the chains 22 at a velocity V to define the upper and lower stretches 14 and 15 of the conveyor belt 9 while the lower stretch 15 is fixed at the bar 37 which remains engaged in the notches 47, the belt 9 will roll around the roller 18 as in a tackle system, the roller 18 being entrained in the clockwise sense. The upper stretch 14 thus advances at a velocity 2V which is equal to the peripheral speed of the driving motor 12. Simultaneously the roller 19, entrained toward the rear at the velocity V with the lower stretch of the lateral chains brings about a retraction of the two lower stretches 16 and 17 of the conveyor belt 9. The latter rolls around the lower roller 19 which is entrained in the clockwise sense. The lower pass or stretch 17, entrained by the drum 12, is displaced at a velocity 2V. The bar 38 is thus able to pass around the drum 12 from the bottom stretch 11 to the forwardly moving top stretch 10 at the velocity 2V and approaches the central region of the apparatus (FIG. 8).

Figure 8:
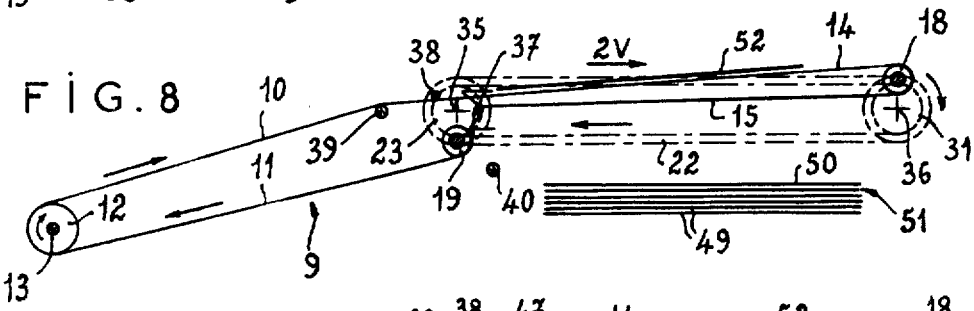

In the phase illustrated in FIG. 8, corresponding substantially to the end of the deposition of the two skins on the stack 49, the two rollers 18 and 19 are substantially opposite one another again but have reversed their positions from FIG. 5. The roller 18 is disposed just above the axis 36 and the roller 19 is disposed just below the axis 35. The two stretches 14 and 15 of the upper arm are at their maximum length substantially equal to the interaxial distance A between the pinions 23 and 31 while the stretches 16 and 17 of the roll arm are practically eliminated. The bar 38, carried by the conveyor belt 9, is disposed substantially at the level of axis 35 proximal to the member 46 provided with the notches 47.

Figure 9:
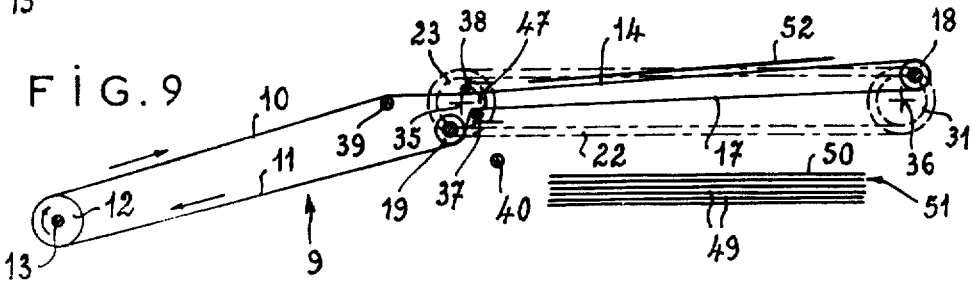

The movement of the chains 22, as represented in FIG. 9, causes the rollers 18 and 19 to begin their circular trajectories around the respective axes 36 and 35 while the ends of the bar 38 pass between the guides 48 into the notches 47. The roller 39 ensures that bar 38 will enter the notches above the bar 37 which passes beneath the roller 39 and emerges from the notches 47. In this position the chains 22 can be arrested as described in connection with FIG. 5 in accordance with the cadence at which the objects are deposited on the conveyor. Of course continuous operation of the chains is also possible without modification of its functioning.

Let us suppose, for convenience, that the motor-reducer 30 has been turned off and the lateral chains 22 stopped, by, for example, a limit switch or the like. Because of the tractive force which continues to be applied by the friction transmission 45 and the drum 12 to the conveyor belt 9, the latter will continue to be driven in the direction of the arrows (FIG. 9). The bar 37 is withdrawn by the movement of the lower stretch 11, 17 of the conveyor belt 9 from the notches 47 while the tractive force supplied around roller 18 shifts the upper stretches 10, 14 to the right to insert the bar 38 into the notches 47 in place of the bar 37. The apparatus is thus again brought into the position illustrated in FIG. 5 except that the bar 38 has replaced the bar 37 in the notches 47 and the roller 19 has replaced the roller 18 and vice versa. The cycle can then be repeated.

In reality, each cycle as described is a half cycle if one considers the rollers or the bars and a complete return to the positions illustrated in FIG. 5 to be required. For the present purposes, however, a cycle will be understood to mean a functioning cycle wherein a repetition of the sequence results in a repetition of the deposit of a pair of skins on the pile or stack.

FIGS. 5 to 9 also permit explanation of the different modes in which the apparatus can be used.

The sequence of objects are deposited upon the upper stretches 10, 14 of the belt 9 by the disk conveyor 6 and the movements of the conveyor belt 9 deposit them upon the table 2. In the manner previously described, it has been shown how this sequence can be deposited with "marriage". Simpler cases can be deduced with ease.

Suppose, for example, that in the start of the cycle (FIG. 5) a skin 49 has already been deposited in the stack on the table 2 and the upper stretch 14 of the endless conveyor 9 receives a new skin 51 to be deposited. This skin is lowered with the roller 19 and the upper pass 14 (FIG. 6) and is eventually deposited as shown in FIG. 7. This skin is deposited without inverting its sense or turning it over. If no new skin 50 is thus supplied as shown in FIG. 6, each skin 51 starting from the position shown in FIG. 5 will be deposited in regular order, i.e. without "marriage". Assume, moreover, that it is desired to stack the skins upon inversion, i.e. after turning them over, without "marriage". In this case the apparatus starts from the position illustrated in FIG. 5 without a skin 51 and the skin 50 is supplied as shown in FIG. 6. Skin 52 is not fed until the FIG. 6 position is again reached in this case, the skin 50 will be turned over and deposited on the stack 49 in its inverse position. It is possible to stack the skins with the hair side up, with the hair side down, i.e. with or without inversion and, of course, with "marriage" as described.

To accommodate for the increase in height of the stack of skins 49 on the table 2, it is necessary to elevate the front end of the frame 3 by swinging same about its axis 4. This elevating operation is activated by a photoelectric cell 53 (see FIGS. 1 and 10) disposed on the underside on the frame 1 and positioned opposite a light source 54 likewise fixed on the underside of the frame 3 such that a pencil of light 55 traverses diagonally the zone in which the skins are stacked (see FIG. 2). When the pile of skins 49 attains a height in which the lower pass 17 of the belt 9 might come into contact with the object previously stacked, the photocell 55 responds to the interruption of the beam and actuates a pneumatic cylinder 56 controlled by an electric valve 57. Compressed air is fed from the valve 57 to the cylinder 56 to raise the frame 3.

(i.) Electronic Circuits

Figure 10:
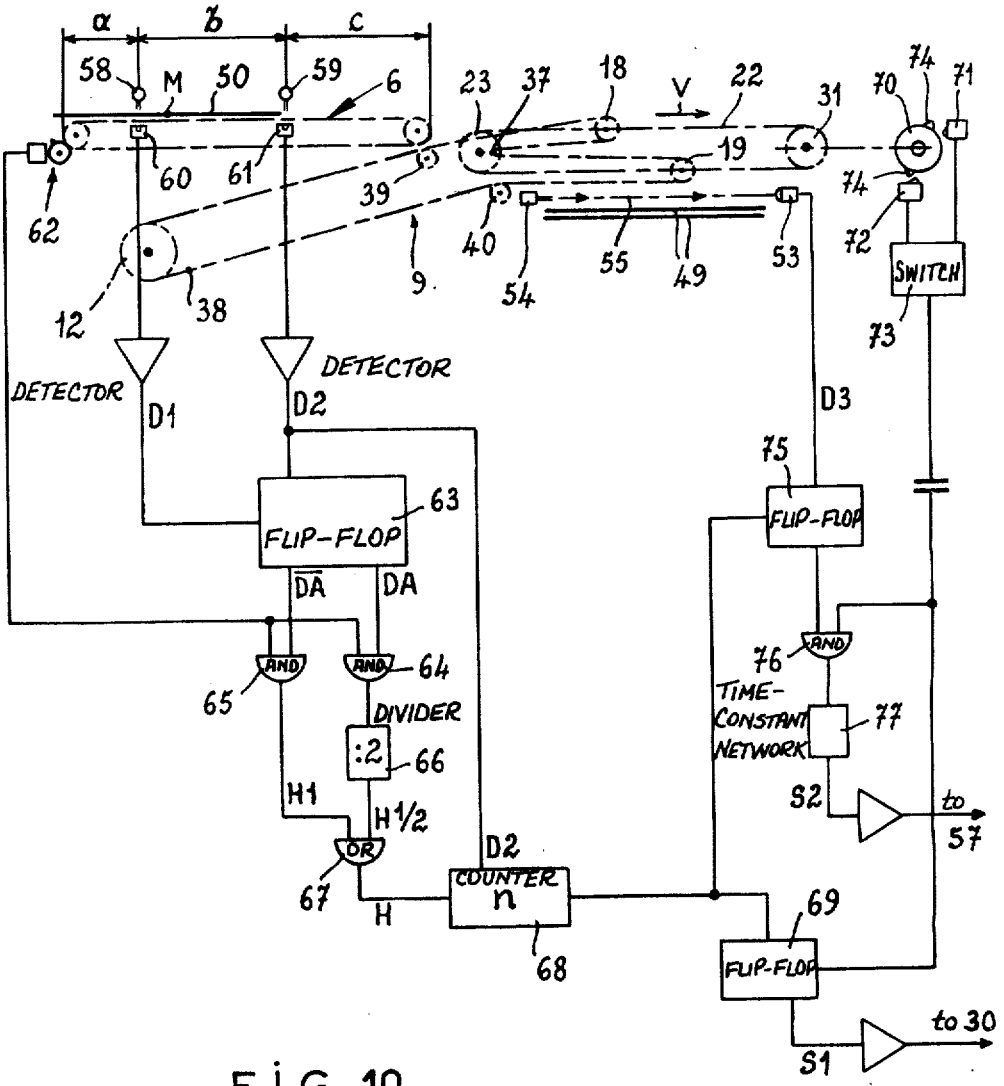
FIG. 10 is a block diagram showing the control system for the apparatus in association with the controlled portions thereof.

FIG. 10 shows the electronic circuit of the apparatus which comprises two parts, firstly, a system for synchronizing the movements of the lateral chains 22 with the arrival of the skins on the disk conveyer 6 and a system for controlling the energization of the electrical valve 57 for raising the frame 3 in response to the photocell 53.

The synchronizing circuit comprises a detecting system composed of two light curtains formed by arrays of lamps 58 and 59 and two arrays of photoelectric cells 60 and 61 corresponding to the lamps, the arrays being disposed transversely.

The associated light and photocell bars of the first light curtain 58, 60 are disposed at a distance *a* from the rear end of the disk conveyor 6 which has been illustrated only diagrammatically in FIG. 10. The two other associated bars 59 and 61 of the second light curtain are located at a distance *b* forwardly of the first light curtain, the second light curtain being positioned at a distance *c* from the front end of the disk conveyor. These dimensions are chosen such that the total length ($a + b + c$) of the disk conveyor 6 is substantially equal to the maximum L' of the object to be deposited (stacked) multiplied by a factor of 1.25 in accordance with the relations:

$a = 0.25\ L'$
$b = 0.5\ L'$
$c = 0.5\ L'$.

The detector system (FIG. 10) comprises a pulse generator 62 synchronized with the location of the disks 6a of the disk conveyor 6, which is continuously operated, permitting a determination of the sector M of the objects arriving on the disk conveyor. More precisely, the detector can determine the center of length of each object and trigger the operating cycle of the components of the stacking apparatus as described with respect to FIGS. 5–9 when this center reaches a predetermined location, thereby centering the skins perfectly upon the stretches of conveyor 9 and the pile formed thereby.

To this end, the most rearwardly photoelectric cells 60 deliver a logic signal D1 to a bistable multivibrator (flip-flop) 63. The photoelectric cells 61 disposed forwardly of cells 60 deliver a second logic signal D2 to the other input of flip-flop 63. The output state DA of this flip-flop 63 becomes "1" when the signal D2 is applied and reverts to "0" when the signal D1 becomes "0". The outputs of the flip-flops 63, which deliver the signal DA and also the complementary signal DA are connected to the inputs of the AND gates 64 and 65 which also receive input pulses from the pulse generator 62. The output of the AND gate 64 is connected to a divider 66 with a divisor factor of two, and an OR gate 67 receiving the pulses H ½ delivered by the divider 66. The OR gate 67 also receives the pulses H1 issuing from the AND gate 65. The pulses H delivered by the OR gate 67 are applied to the input of a counter 68 whose maximum capacity is *n* which corresponds to half the number of pulses delivered by the generator 62 during the passage of a skin between the two pairs of light curtains 58, 60 and 59, 61 in the course of an advance equal to the distance *b*. The counter 68 has an input which can set the counter to zero upon receipt of the signal D2. The output of the counter is connected to an input of another bistable multivibrator (flip-flop) 69.

The second input of the bistable multivibrator 69 is supplied from a system which arrests the cycle, this system comprising a rotatable cam 70 whose movement is synchronized with that of the lateral chains 22, two electrical contacts or other detectors as represented at 71 and 72 fixed along the periphery of this cam, and a manual commutator or switch 73 having three positions and which permits enabling of the bistable multivibrators 69 by one of the contacts 71 and 72 selectively, or by the two contacts at the same time.

In the embodiment illustrated, the cam 70 can be assumed to have described a single rotation for a "complete" cycle of the mechanical parts of the apparatus. In this case two diametrically opposite projections 74 are provided on the cam 70 to cooperate with the contacts 71 and/or 72 so as to start and stop the half cycles mentioned above. Of course each half cycle results in the deposition of a single skin or a pair of skins in face-to-face relationship on the stack.

The output signal S1 of the bistable multivibrator 69 is amplified and serves to actuate or stop the motor-reducer 30 connected to the lateral chains 22.

Upon the arrival of a new skin 50 on the disk conveyor 6, the system described previously functions in the following manner:

As long as the object does not block the light curtain of photocells 61, the latter emits a signal D2 equal to "0" which cancels the count in the counter 68 and, therefore, no count accumulates therein. When the object arrives at the second light curtain (the position shown in FIG. 2) which, according to the speed of the object has at least three-quarters of its length lying on the conveyor, the output of the photocells 61 (D2) becomes "1" and the counter 68 accumulates a number of impulses from the generator 62 representing the beginning of a measurement of the length of the object 50. As long as the object 50 interrupts the first light curtain such that both photocells 60 and 61 are blocked, the state DA of the bistable multivibrator 63 is equal to "1" and the circuit network comprising the AND gate 64, the divider 66 and the OR gate 67 delivers a pulse train H ½ and a pulse H for two pulses of the generator 62.

When the object no longer blocks the first set of photocells 60, the signal D1 delivered by the latter reverts to the "0" level and transforms the state DA of the bistable multivibrator 63 to "0" so that, via the gate 65 and the OR gate 67, at each pulse of the generator there is produced a pulse H1 and a pulse H.

The accumulations of pulses H and the counter 68 eventually reaches the level *n* corresponding to the passage of the centered M of the length of the object 50 past a second light curtain. This effect is obtained whenever the object has a length which is comprised between the distances *b* and 2*b*, where *b* is the aforedescribed distance separating the two light curtains. High precision is obtained in the determination of the center M when the interval of time between two pulses of the generator 62 represents an advance of the disk conveyor of the order of one or more centimeters.

For objects whose length is substantially less than *b* or greater than 2*b*, the accumulation of the maximum value *n* at the counter is not able to represent accurately the position of the center M of the object although the error is small.

When the counter reaches its maximum level *n*, it transmits a signal to the bistable multivibrator 59 which switches it to its "1" state and thus actuates the motor reducer 30. The mechanical cycle described above is then carried out and the new skin 50 can be deposited on the stack. In order to obtain perfect synchronization with the arrival of the skin, it has been found to be advantageous to select the speed V of the chains 22 and the starting position accordingly. This may differ depending upon whether the skin is to be deposited with or without inversion on the stack. Of course, it is possible to adjust the maximum count *n* in the counter 68 to shift the instant at which the mechanical cycle is initiated.

After the cycle begins, the counter 68, having reached its maximum count, no longer accumulates the pulses H and is reset to zero as long as no object blocks the photocell 61 so that the circuits are again prepared for the determination of the center of the next object.

The stopping of motor 68 connected to the lateral chains 22, is effected in response to the position of the chains so that the latter can be stopped precisely. To this effect, the cam 70 via the projections 74 activates one of the contacts 71. If all of the skins are intended to be deposited without inversion, the stopping position is different and the projection 74 can then act upon the other contact 72. Thus, in the case of "marriage" of the skins, the chains are stopped when one of the projections 74 engages the contact 71 and the same contact 74 actuates the other contact 72 thereby establishing the two stopping positions corresponding to the two skins for each half cycle. In order to select one of these three modes of operation of the apparatus, the commutator 73 is used to connect the single contact 71 to the bistable multivibrator 69, the single contact 72 thereto or both contacts to the latter. Actuation of one of the contacts 71, 72 applies a signal to the bistable multivibrator 69 which produces an output S1 which turns off the motor-reducer 30.

The remaining circuitry in FIG. 10 constitutes the system for operating the means for elevating the frame 3. This circuit comprises a bistable multivibrator 75 whose one input is connected to the photoelectric cell 53 and whose other input is connected to the output of counter 68. An AND gate 76 receives one input from the output of bistable multivibrator 75 and another input from the contacts 71 and/or 72, depending upon the position of the commutator or switch 73. The output of the AND gate 76 is applied to a timing circuit 77 whose output signal S2 is amplified and applied to the electromagnetic valve 57.

These circuits function such that the electromagnetic valve 57 is opened only if the beam 55 is interrupted during a cycle of the lateral chains 22 and, more accurately, between the instant at which they are started and the instant at which they are stopped. Thus a brief blockage of the cell 53 in the course of deposition of an object does not cause the raising of the support frame 3.

To this end, the photoelectric cell 53 applies a signal D3 of the value "1" if the beam is not interrupted and of the value zero if it is interrupted. While the signal D3 is at the value "1", the bistable multivibrator is maintained in its state "0" and the AND gate 76 is blocked precluding elevation of the frame 3.

At the end of each counting period of the counter 68, corresponding to the arrival of a new skin 50, the pulse transmitted to the bistable multivibrator 75 switches the latter into the state "1" and two cases can be distinguished.

If the beam 55 is not permanently interrupted, the signal D3 takes, at a certain instant, the value "1" which resets the bistable multivibrator 75 to the "0" state. At the end of this cycle, when one of the contacts 71 or 72 emits a signal which reaches the AND gate 77, the latter remains closed and prevents elevation of the frame 3.

If the beam 55 remains interrupted permanently during the course of the cycle, the signal D3 never assumes the value "1" and the bistable multivibrator 75 remains in its "1" state as established at the beginning of the cycle by a pulse provided from the counter 68. At the end of the cycle, when one of the contacts 71 or 72 produces a signal, the two inputs to the AND gate 76 are both at the level "1". This gate is therefore opened and emits a signal in the direction of the time delay circuit 77. The latter supplies S2 which opens the valve 57 for an adjustable period sufficient to enable the pneumatic cylinder 56 to raise the support 3 to compensate for the thickness of the objects deposited.

The electronic circuits described above are supplied by conventional current sources not illustrated and the various elements, including bistable multivibrators, gates, counter etc. are well known to the ordinary skilled worker in the art and hence have not been described or illustrated in detail.

As will be apparent, the invention is not limited to the single embodiment illustrated and described or for use in the stacking of skins. On the contrary, it can include all variants utilizing equivalent means within the scope of the claims and for the stacking of various objects of small thickness wherever such objects must be stacked in the manner described. For example, the disk conveyor can be replaced by other equivalent means capable of feeding the objects to the conveyor belt without departing from the spirit of the invention.

What is claimed is:

1. An apparatus for depositing or stacking objects of small thickness, comprising:

a support having an upstream end adapted to receive said objects in succession and a downstream end;

means at said downstream end for receiving objects to be deposited and disposed below said support;

an endless conveyor belt mounted on said support;

a drum on said support at said upstream end, said conveyor belt passing around said drum and forming a pair of stretches extending from said drum;

a pair of rollers engageable with said conveyor belt and displaceable relative to said drum to define a pair of retractable and extendable conveyor arms at said downstream end of said support;

a pair of displacing elements disposed laterally of said belt and movably mounted on said support for cyclically displacing said rollers to extend an upper one of said arms while retracting a lower one of said arms simultaneously; and a bar affixed to said conveyor belt and engageable with said support upon the displacement of said conveyor belt around said drum and said rollers to immobilize said bar for retaining a portion of said conveyor belt between said rollers while said rollers are displaced by said elements.

2. The apparatus defined in claim 1 wherein a pair of such bars are provided on said conveyor belt, said bars subdividing the length of said conveyor belt into substantially two equal parts.

3. The apparatus defined in claim 2 wherein said elements are endless chains disposed laterally of said conveyor belt and displaceable on respective pairs of sprocket wheels, said chains having first sprocket wheels rotatable about a common axis in the region of the portion of said support at which said bars are immobilized, and second sprocket wheels having a common axis at a downstream end of said support.

4. The apparatus defined in claim 3 wherein said bars extend transversely of said belt across the exterior surface thereof and project laterally therebeyond, said support being provided on opposite sides of said belt with two symmetrical pieces formed with rearwardly open notches receiving the projecting extremities of said bars.

5. The apparatus defined in claim 4 wherein said pieces have rearward extensions and form on the respective extensions guides which converge toward one another in the direction of movement of said bars into said notches.

6. The apparatus defined in claim 4 wherein the axis of said first sprocket wheels lies rearwardly of said notches, said sprocket wheels being mounted upon independent shafts such that the shafts of said first and second sprocket wheels define free spaces between them permitting passage of said belt, said shafts of said first sprocket wheels being provided with respective pinions, said apparatus further comprising a common shaft disposed centrally of said support and journaled thereon, further pinions keyed to said common shaft, respective drive chains connecting said further pinions with the pinions of the shafts of said first sprocket wheels, a motor mounted on said support, and means connecting said motor with said common shaft for synchronously driving the chains entraining said rollers.

7. The apparatus defined in claim 6 wherein the developed length of said conveyor belt is substantially equal to four times the spacing of the axes of said first and second sprocket wheels, plus four times the effective radius of said second sprocket wheels, plus the circumference of one of said rollers.

8. The apparatus defined in claim 4 wherein said drum is movably journaled on said support, said apparatus further comprising means for biasing said drum toward the rear of said support for maintaining a constant tension on said belt.

9. The apparatus defined in claim 8 wherein said support comprises a pair of levers pivotally mounted on said support and journaling said drum between them, and spring means acting upon said levers to tension said belt.

10. The apparatus defined in claim 8, further comprising a motor mounted on said support and a slip transmission connecting said motor with said drum for driving said belt at a velocity slightly greater than twice the linear velocity of the chains entraining said rollers.

11. The apparatus defined in claim 4 wherein an idler roller is positioned rearwardly of said axis of said first pinions sprocket wheels and substantially at the level of said notches to support the upper stretch of said belt between the upper one of said rollers and said drum.

12. The apparatus defined in claim 11, further comprising another idler roller disposed substantially below said notches for supporting the lower stretch of said belt.

13. The apparatus defined in claim 4, further comprising a feed conveyor at said upstream end of said support adapted to feed said objects in succession onto an upper stretch of said conveyor belt.

14. The apparatus defined in claim 13, further comprising detector means disposed along said feed conveyor for detecting the passage of said objects for energizing said chains upon the arrival of each object.

15. The apparatus defined in claim 14 wherein said objects are skins and said feed conveyor is a disk conveyor.

16. The apparatus defined in claim 14 wherein said detector means comprises a pair of light curtains disposed transversely of said feed conveyor and electronic circuit means connected to said light curtains and adapted to determine the position of the center of length of the objects traversing said feed conveyor.

17. The apparatus defined in claim 16 wherein said electronic circuit means comprises a first bistable multivibrator receiving inputs from said light curtains, a pair of AND gates respectively energized by outputs from said bistable multivibrator, a pulse generator synchronized with said feed conveyor for applying further inputs to said AND gates, counter means responsive to said AND gates for detecting the center of said objects, a further bistable multivibrator receiving an input from said counter means, and means responsive to the positions of said chains for applying another input to the last-mentioned bistable multivibrator, said last-mentioned bistable multivibrator having an output controlling the positions of said chains entraining said rollers.

18. The apparatus defined in claim 17 wherein the means responsive to the position of said chains comprises a rotatable cam synchronized with said lateral chains and a pair of electrical detectors responsive to the position of said cam, a commutator switch connected to said detectors and adapted selectively to apply said detectors individually or together to said last-mentioned bistable multivibrator.

19. The apparatus defined in claim 4 wherein said support is a frame mounted for pivotal movement about a horizontal axis at said upstream end of said support, said apparatus further comprising a detector responsive to the stacking of objects by said belt, and means responsive to said detector for swinging said frame.

20. The apparatus defined in claim 19 wherein said detector means comprises a photocell and a source of light training a beam at said photocell and disposed on the underside of said support, and circuit means connected to said photocell for swinging said support only if said beam is interrupted permanently in the course of a cycle of deposition of an object.

21. The apparatus defined in claim 20 wherein said circuit means includes a bistable multivibrator having a first input connected to said photocell, a second input connected to a counter responsive to the feeding of said objects to said conveyor belt, an AND gate having an input connected to the output of said bistable multivibrator, a commutator operated by said lateral chains, means for applying a signal from said commutator to said AND gate as a further input thereto, and a timing network connected to the output of said AND gate and operating the means for swinging said support.

* * * * *